US007513294B2

(12) United States Patent
Jelic et al.

(10) Patent No.: US 7,513,294 B2
(45) Date of Patent: Apr. 7, 2009

(54) SYSTEM FOR SUSPENDING NON-RETRACTABLE SHADES IN ARCHITECTURAL OPENINGS

(75) Inventors: Ralph G. Jelic, Boulder, CO (US); Terry L. Akins, Louisville, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 164 days.

(21) Appl. No.: 11/560,018

(22) Filed: Nov. 15, 2006

(65) Prior Publication Data

US 2007/0119551 A1 May 31, 2007

Related U.S. Application Data

(60) Provisional application No. 60/737,715, filed on Nov. 16, 2005.

(51) Int. Cl.
*A47H 5/00* (2006.01)

(52) U.S. Cl. ..... 160/349.1; 160/84.07

(58) Field of Classification Search ..... 160/84.04, 160/84.05, 84.07, 134, 902; 248/208, 222.11, 248/224.7

See application file for complete search history.

(56) References Cited

U.S. PATENT DOCUMENTS

| | | | | |
|---|---|---|---|---|
| RE22,311 | E | 5/1943 | Roy | |
| 3,386,490 | A | 6/1968 | Kandel | |
| 3,490,515 | A | 1/1970 | Kandel | |
| 4,827,565 | A * | 5/1989 | Froutzis | 16/87.4 R |
| 4,846,243 | A | 7/1989 | Schneider | |
| 5,129,440 | A | 7/1992 | Colson | |
| 5,611,111 | A * | 3/1997 | Bosgoed | 16/93 D |
| 5,791,390 | A | 8/1998 | Watanabe | |
| 5,946,732 | A * | 9/1999 | Richards | 2/247 |
| 6,033,504 | A | 3/2000 | Judkins | |
| 6,572,725 | B2 | 6/2003 | Goodhue | |
| 6,585,027 | B1 * | 7/2003 | Roberts | 160/349.1 |
| 6,601,637 | B2 | 8/2003 | Toti | |
| 6,792,996 | B1 | 9/2004 | Yu et al. | |
| 6,834,702 | B2 | 12/2004 | Nien | |
| 2002/0043347 | A1 | 4/2002 | Rupel | |
| 2004/0200585 | A1 * | 10/2004 | Whittemore | 160/368.1 |
| 2006/0048901 | A1 | 3/2006 | Nien | |

FOREIGN PATENT DOCUMENTS

| | | |
|---|---|---|
| EP | 0 451 912 A1 | 10/1991 |
| EP | 1 431 506 A2 | 6/2004 |
| EP | 1 479 867 A2 | 11/2004 |
| EP | 1 561 896 A2 | 8/2005 |
| EP | 1 619 348 A1 | 1/2006 |

* cited by examiner

*Primary Examiner*—Katherine W Mitchell
*Assistant Examiner*—Jaime F Cardenas-Garcia
(74) *Attorney, Agent, or Firm*—Dorsey & Whitney LLP

(57) ABSTRACT

A mounting system for securing a non-retractable covering material in an architectural opening includes an anchor strip securable to the covering material having a plurality of openings therethrough and a three piece clip securable to the surrounding frame of the architectural opening including a taper head pin for insertion into an opening in the anchor strip with the pin being universally movable through a unique design of the clip which includes a base, a pivot arm and a slide clamp on the pivot arm.

9 Claims, 12 Drawing Sheets

SYSTEM FOR SUSPENDING NON-RETRACTABLE SHADES IN ARCHITECTURAL OPENINGS

CROSS REFERENCE TO RELATED APPLICATION

The present application claims the benefit under 35 U.S.C. § 119(e) to U.S. Provisional Patent Application No. 60/737,715 ("the '715 application"), which was filed on Nov. 16, 2005, and entitled System for Suspending Non-Retractable Shades in Architectural Openings." The '715 application is incorporated by reference into the present application in its entirety.

BACKGROUND OF THE INVENTION

1. Field of the Invention

The present invention relates generally to coverings for architectural openings and more specifically to a system for suspending a non-retractable covering in an architectural opening with a particular benefit residing in its ability to suspend non-rectangular coverings in complimentary non-rectangular openings.

2. Description of the Relevant Art

Coverings for architectural openings such as doors, windows, archways and the like have existed for numerous years, such coverings assuming a number of various forms. Some coverings are non-retractable and typically in the form of a fabric draped across a rod in front of an architectural openings. Most coverings, however, are retractable so as to be moveable between an extended position across the architectural opening and a retracted position adjacent one or two sides of the opening. Examples of retractable coverings include Venetian blinds, vertical blinds, cellular shades, draperies and the like.

Inasmuch as not all architectural openings are rectangular in shape so as to readily accept a conventional retractable or non-retractable covering, mounting systems for coverings for such non-rectangular openings are necessary. Systems have been devised for mounting a retractable covering in non-rectangular architectural openings with an example of such being described in pending U.S. Provisional Application Ser. No. 60/747,688 filed May 19, 2006, and entitled Operating System for Arched Covering for Architectural Opening, which is of common ownership with the present application.

Systems for mounting non-retractable coverings in non-rectangular architectural openings have also been devised with an example of such being shown in pending U.S. application Ser. No. 11/219,413 filed Sep. 2, 2005, which is also of common ownership with the present application.

Mounting coverings in architectural openings can be labor intensive if the system employed is not user friendly and this is particularly true where the architectural opening is non-rectangular in configuration. There is accordingly an interest in developing improved systems for mounting non-retractable coverings in architectural openings which may be non-rectangular in configuration. It is to fulfill this interest that the present invention had been developed.

SUMMARY OF THE INVENTION

The mounting system of the present invention can be used with coverings for architectural openings that are rectangular or non-rectangular in configuration. It includes a universally adjustable clip mountable on the frame surrounding an architectural opening and a cooperating anchor strip to which the clip can be secured which is securable to the covering material being mounted within the framework of the architectural opening.

The adjustable clip includes a base that is securable to the framework around the architectural opening and can be moved within limits universally about a fastener. Accordingly. after inserting a fastener loosely through the base and into the frame of the opening, the base is movable in both x and y directions to position the base as desired.

The base supports a pivot arm having an adjustable clamp slidably mounted thereon for releasable positioning at a plurality of locations along the length of the pivot arm. The clamp has a tapered head pin projecting laterally away therefrom which can be selectively inserted into one of a plurality of holes in the anchor strip mounted on the covering material. The tapered head pin is therefore universally positionable relative to the base by pivotal movement of the pivot arm as well as sliding movement of the clamp, on which the tapered head pin is mounted, along the pivot arm.

Accordingly, once the anchor strip has been secured to the covering material in any suitable manner, there are a plurality of holes therein adapted to receive the tapered head pin and by manipulating the tapered head pin through its universal mounting, the tapered head pin is alignable with a hole in the anchor tape and once so aligned, can be inserted into the hole to releasably connect the clip to the material thereby positively holding one portion of the material relative to the frame of the architectural opening.

A plurality of the clips can be positioned along the perimeter of the covering for the architectural opening as desired for dependable support of the covering material. As will be appreciated, the covering material can be cut or otherwise formed to conform with the size and configuration of the architectural opening and secured to the frame around the opening with a desired number of clips so that the covering completely fills the opening in conformity therewith.

Other aspects, features and details of the present invention can be more completely understood by reference to the following detailed description of the preferred embodiment, taken in conjunction with the drawings and from the appended claims.

DESCRIPTION OF THE PREFERRED EMBODIMENT

Figure 1:
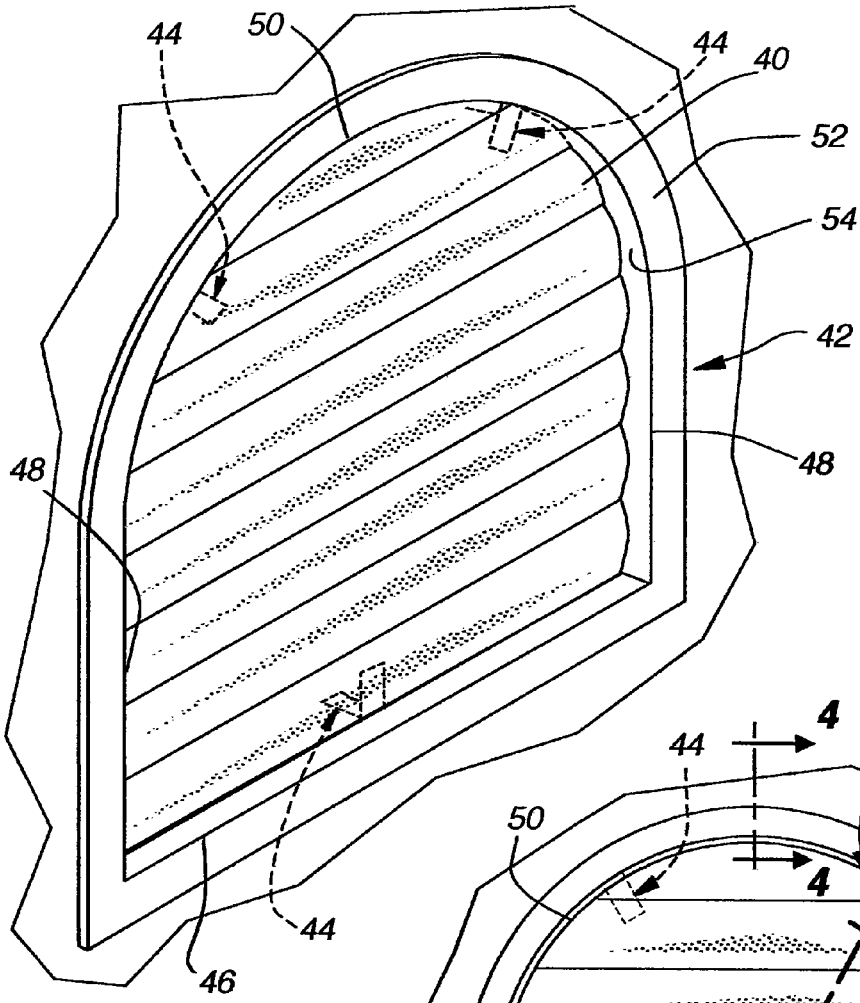
FIG. 1 is an isometric of a covering mounted within an architectural opening with the mounting system of the present invention and wherein the clips for the system are shown diagrammatically in dashed lines.
Figure 2:
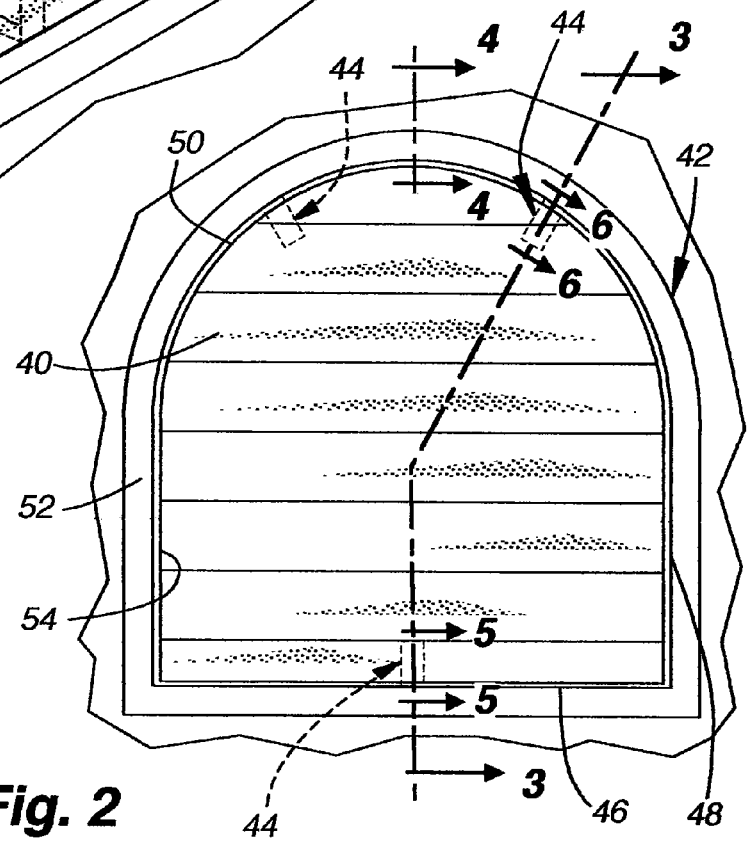
FIG. 2 is the front elevation of the covering and architectural opening shown in FIG. 1

With reference to FIGS. 1 and 2, a non-retractable covering material 40 is illustrated mounted within a non-rectangular frame of an architectural opening 42 with the mounting system 44 of the present invention. For purposed of illustration only, the mounting system is shown in an architectural opening having a straight horizontal bottom 46, a pair of straight perpendicular sides 48 and a semi-circular top 50. The architectural opening is defined by a frame 52 extending along the bottom, sides and top and including an inwardly directed uninterrupted smooth wall or surface 54. Within the opening is the covering material 40 which may be of the type shown and described in detail in copending U.S. application Ser. No. 10/581,872, filed Jun. 5, 2006, which application is the Section 371(c) filing of PCT International Application No. PCT/US2004/043043, which is of common ownership with the present application. It should be appreciated, however, that the covering material suspended within the architectural opening could be any type of covering material and would not need to be of the particular type illustrated. It should also be appreciated the mounting system can be used in architectural openings that are rectangular or non-rectangular in configuration.

Figure 3:
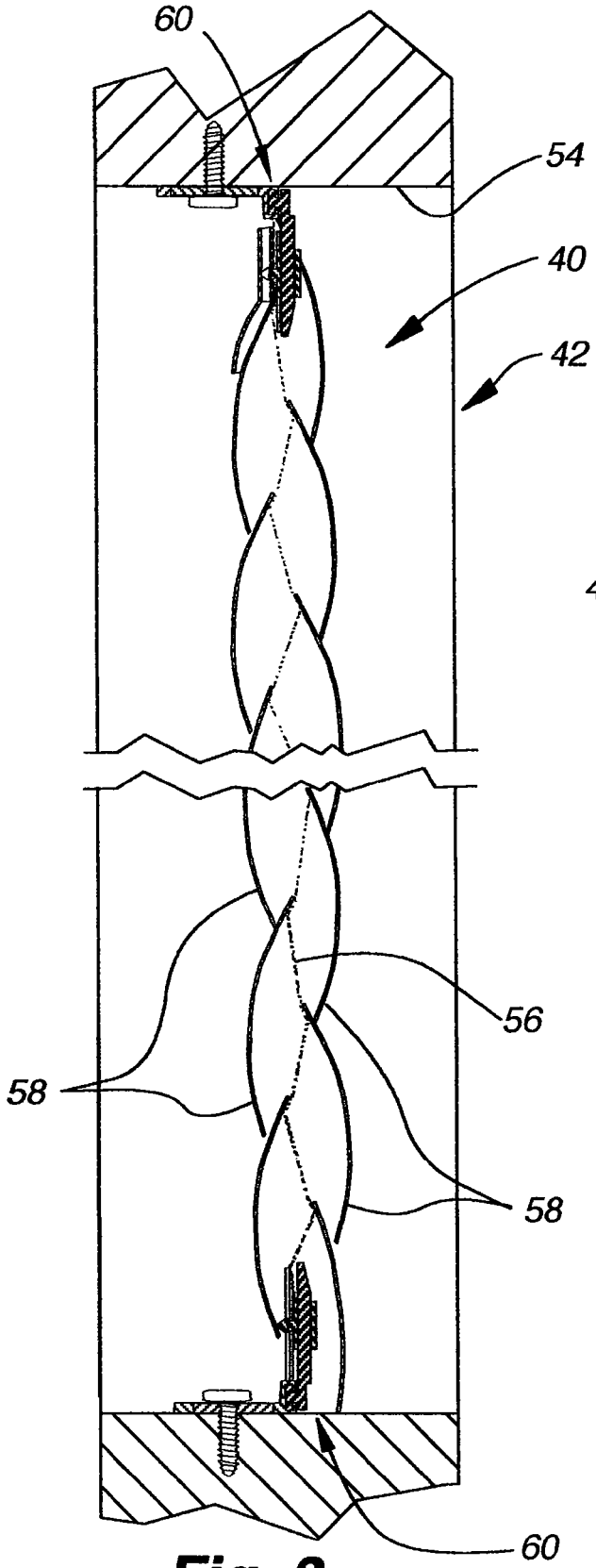
FIG. 3 is an enlarged fragmentary section taken along line 3-3 of FIG. 2
Figure 4:
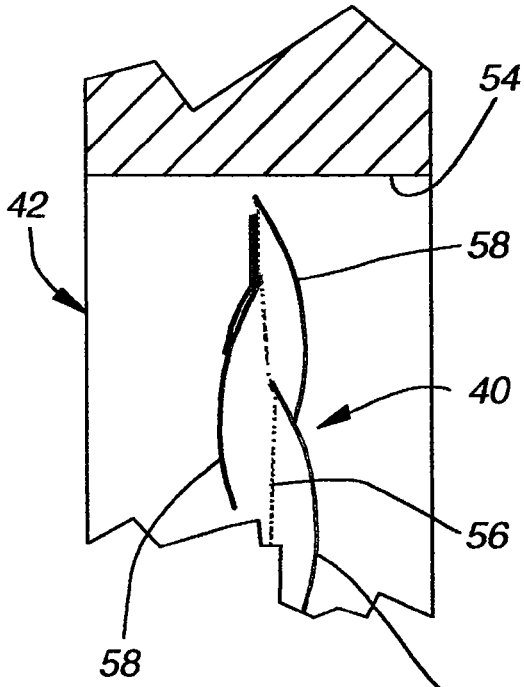
FIG. 4 is an enlarged fragmentary section taken along line 4-4 of FIG. 2.

With reference to FIG. 3, the covering material 40, which is shown for illustrative purposes only, includes a flexible support structure 56 which could be a shear fabric, micro-fibers, cords or the like with a plurality of overlapping vanes 58 suspended on both a front a rear side thereof. The vanes are semi-rigid and illustrated as being arcuate in transverse cross section. While the covering material 40 is collapsible by its nature, when mounted in the afore-described architectural opening 42 with the mounting system 44 of the present invention, it becomes non-retractable or non-collapsible and is therefore fixed in position within the opening.

The mounting system 44 of the present invention includes a clip 60 which cooperates with a perforated anchor strip 62 secured to the covering material 40. A plurality of clips are utilized to support the covering material with such clips being diagrammatically illustrated in FIGS. 1 and 2. The clips are positioned at strategic locations along the perimeter of the covering material so as to hold the material in a fully extended, non-retractable position. In the architectural opening illustrated in FIGS. 1 and 2 it will be seen that a pair of clips 60 are mounted at spaced locations along the semi-circular top 50 of the architectural opening and a single clip 60 along the opposing bottom 46 of the opening at the transverse center of the bottom.

Figure 7:
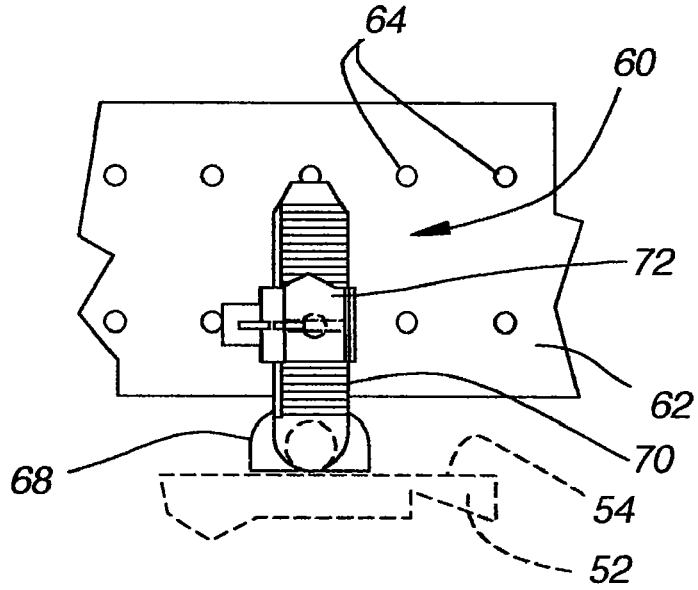
FIG. 7 is an elevational view of the system of the present invention showing the clip adjoined with the anchor strip in a first orientation.
Figure 8:
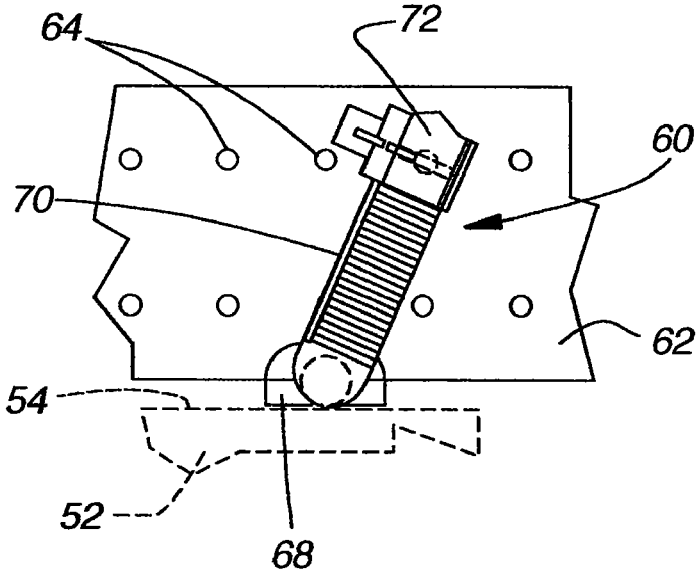
FIG. 8 is a view similar to FIG. 7 with the clip in a second orientation.
Figure 9:
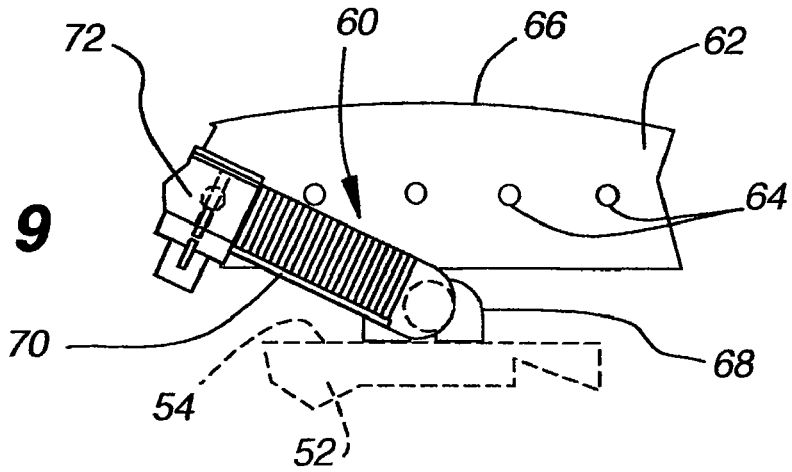
FIG. 9 is a view similar to FIG. 7 with the clip in a third orientation.

The anchor strip 62, to which a clip 60 is connectable, is shown in FIGS. 7-9 and 12 to comprise an elongated strip of generally rectangular configuration in which two rows of perforations or openings 64 through the strip have been provided. The strip is preferably made of a somewhat rigid material having some flexibility and resiliency for a purpose to be described hereafter. Polycarbonate or polyurethane plastics would be an example of suitable materials. The strip of material is adapted to be secured to the covering material 40 along the edge of the material where a clip 60 is to be secured to the frame 52 of the architectural opening. The strip is secured to the material in any suitable manner such as with adhesive, ultrasonic bonding or the like. In the illustrated embodiment and with reference to FIGS. 1 and 2, while the strip 62 is not seen, it would be mounted horizontally adjacent to the top of the covering material 40 so as to be exposed to the locations where the two upper clips 60 are positioned in the architectural opening. A second strip 62 would be secured to the covering material along its bottom edge again so as to be exposed to the clip at the bottom of the architectural opening. If necessary, and as seen in FIG. 9, the strip can be cut to any desired configuration, such as with an arcuate top 66, if necessary to generally conform with the configuration of the architectural opening and the covering material at the location where the strip is secured to the material. This may or may not necessitate the removal of one row of holes or perforations 64 as illustrated in FIG. 9.

Figure 5:
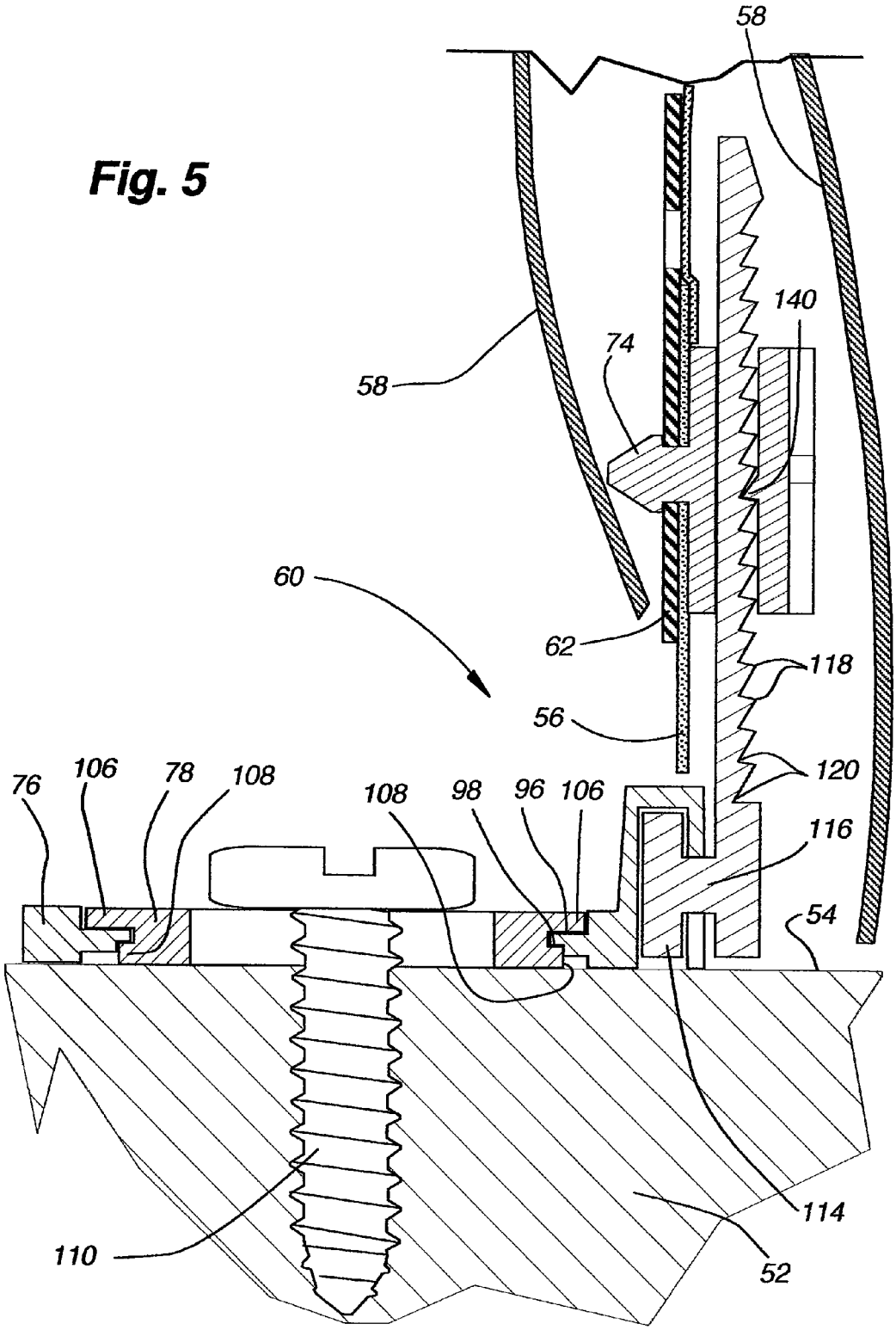
FIG. 5 is a further enlarged section taken along line 5-5 of FIG. 2
Figure 6:
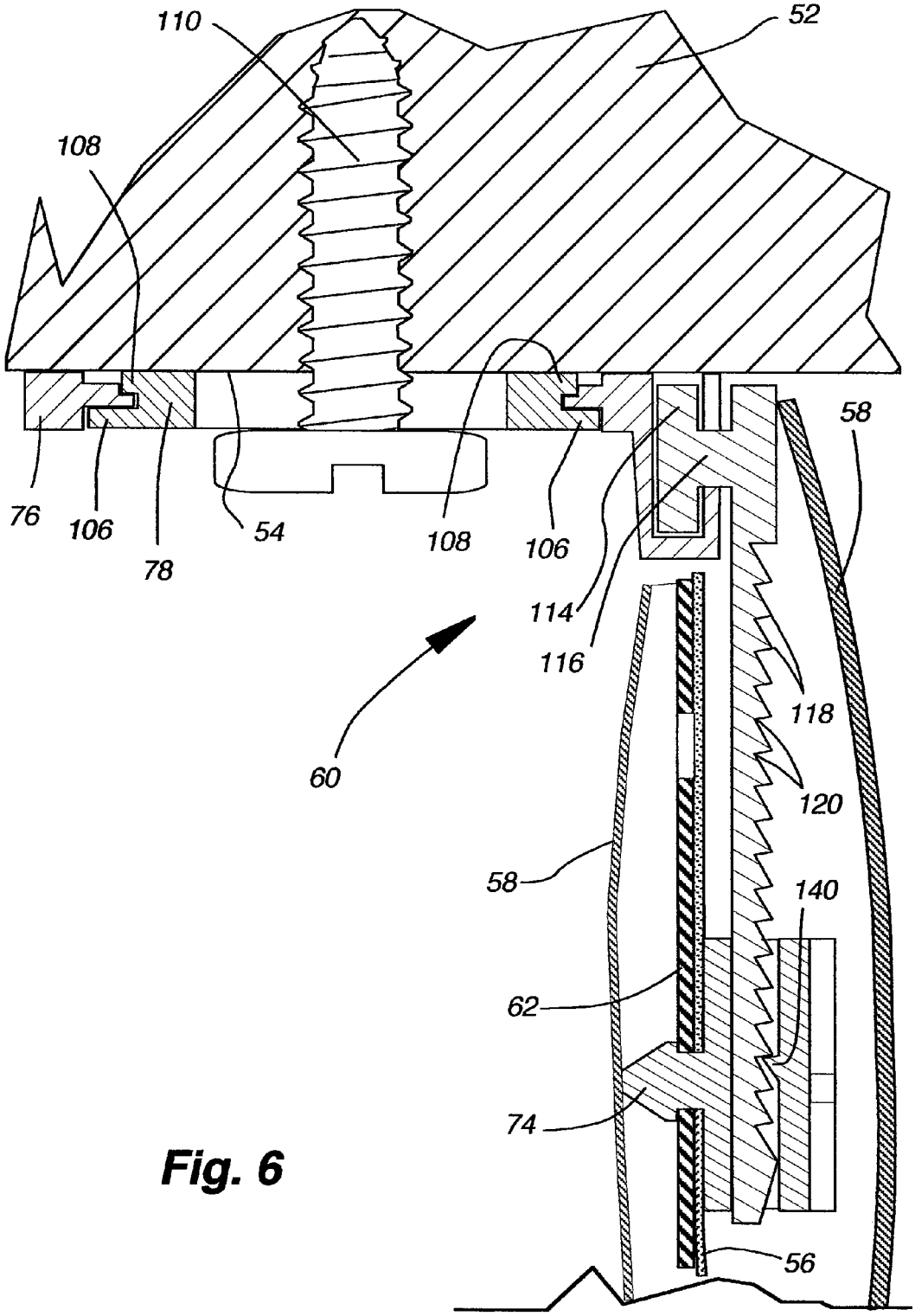
FIG. 6 is a further enlarged section taken along line 6-6 of FIG. 2.

Referring to FIGS. 3, 5 and 6, the anchor strip 62 is shown secured to the support structure 56 of the covering material 40 and at locations which are adjacent to the clips 60 to be described in detail hereafter. For reasons that will become clear with the later description, the strips do not have to be precisely located on the covering material but only generally positioned so as to be exposed to and adjacent to a clip.

Figure 10:
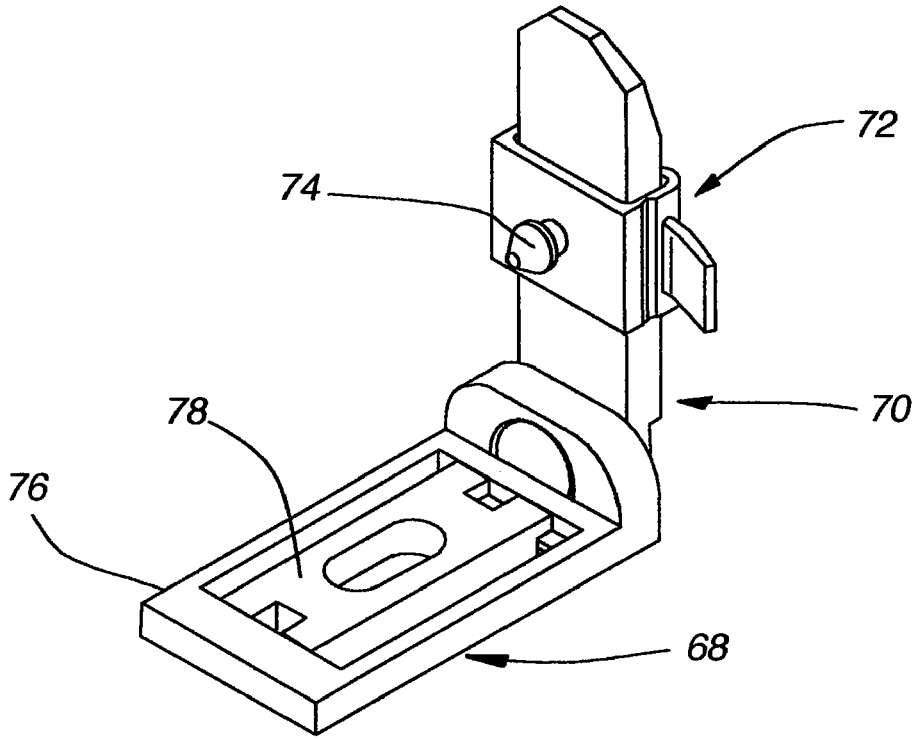
FIG. 10 is a isometric looking downwardly on the front of the clip of the system of the present invention.

The clips 60 are identical with an assembled clip being shown in FIG. 10. The clip includes a base 68, a pivot arm 70 and a slidable clamp 72 mounted on the pivot arm. As will be described in more detail hereafter, the slidable clamp includes a taper head pin 74, which can be inserted into a hole or perforation 64 of the anchor strip 62 once the clip has been desirably mounted on the frame 52 for the architectural opening. As will also be appreciated with the description hereafter, the taper head pin is universally positionable so that it can always be aligned with an opening in an adjacent anchor strip regardless of how precisely the anchor strip may have been positioned on the covering material.

Figure 11:
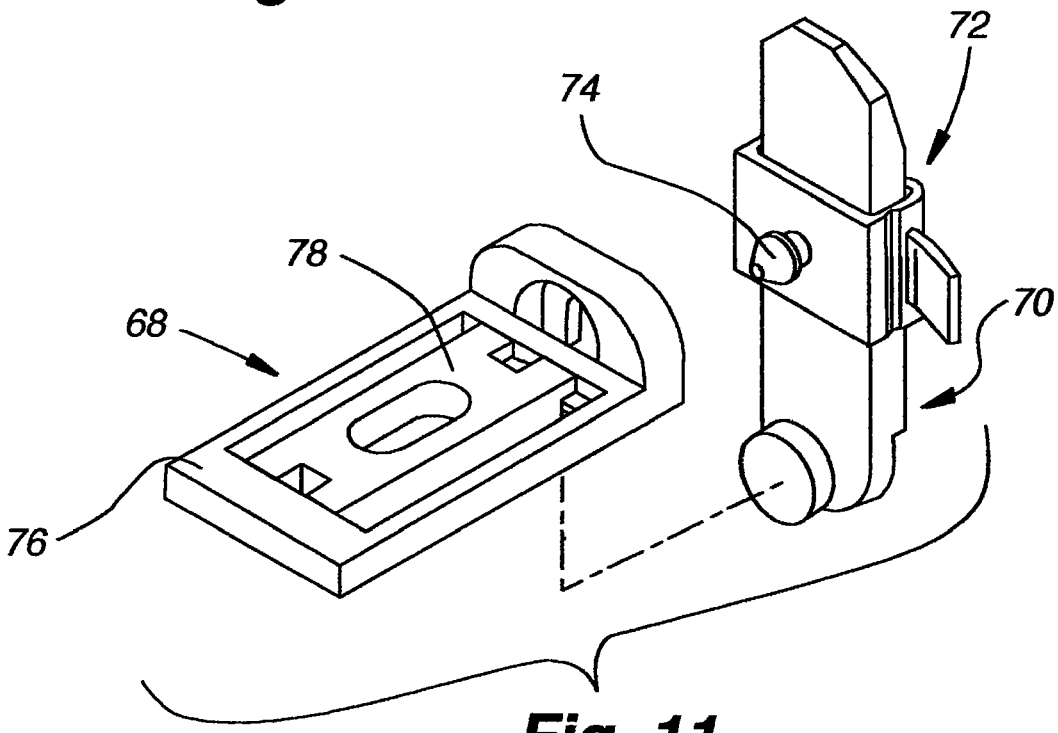
FIG. 11 is an isometric similar to FIG. 10 with the base separated from the pivot arm.
Figure 12:
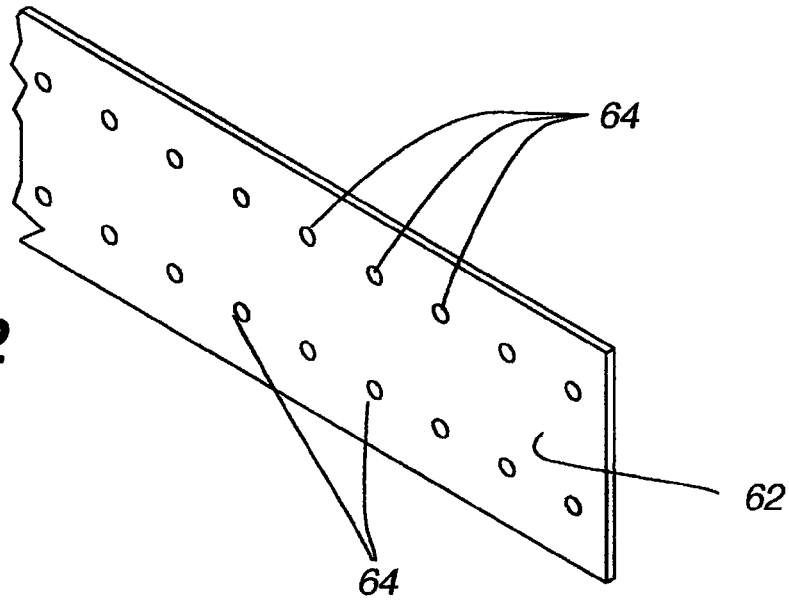
FIG. 12 is a isometric of the anchor strip used in the system of the present invention.
Figure 13:
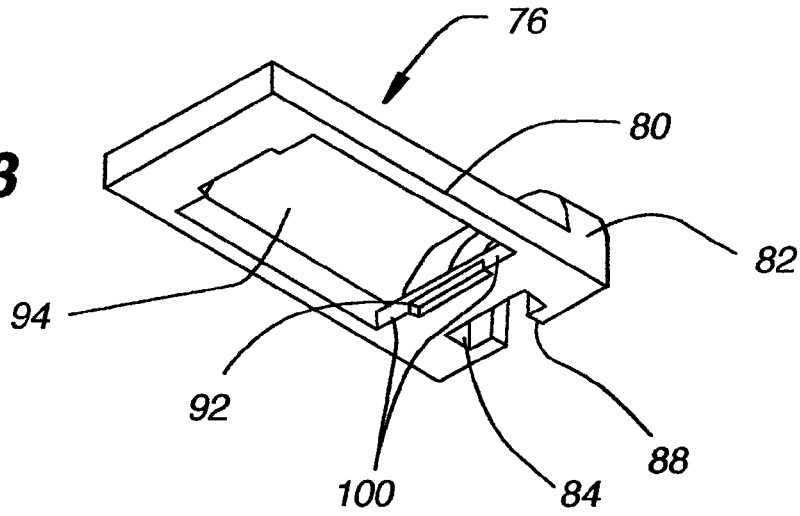
FIG. 13 is an isometric looking at the frame component of the base shown in FIG. 10.
Figure 15:
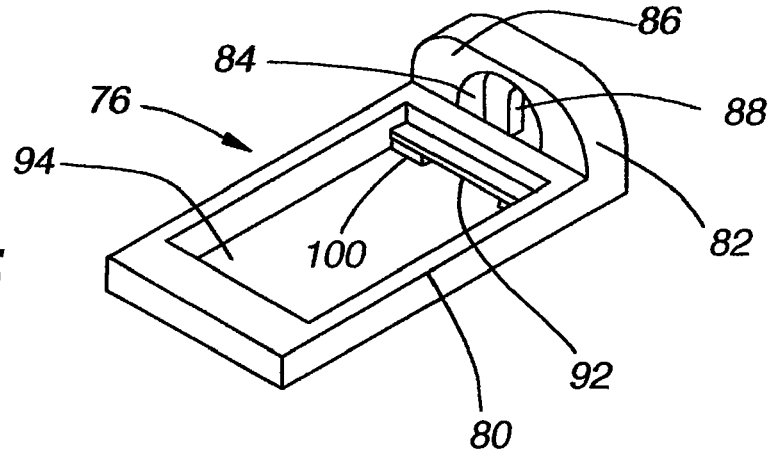
FIG. 15 is an isometric looking downwardly on the top of the frame component.
Figure 17:
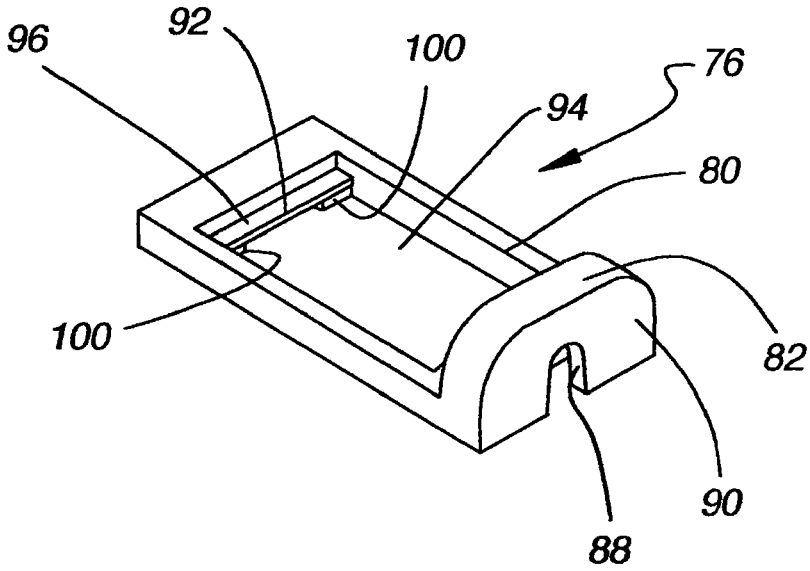
FIG. 17 is an isometric similar to FIG. 15 looking at the frame component from a different angle.
Figure 18:
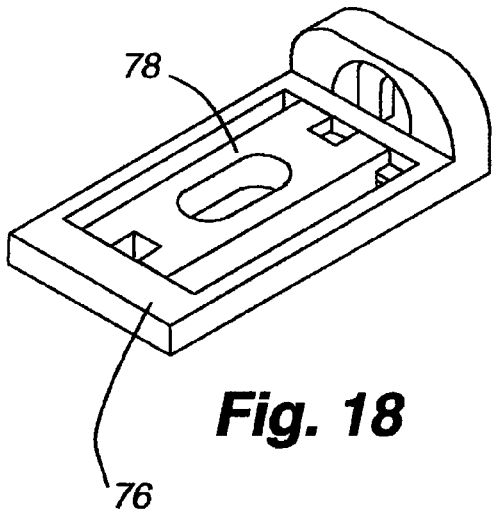
FIG. 18 is an isometric looking downwardly on the base with the slide component mounted in the frame component.

The base 68 of the anchor clip 60, which is seen assembled in FIGS. 10, 11 and 18, includes two component parts, a base frame 76 and a base slide 78. The base frame, as seen in FIGS. 13, 15 and 17, includes a peripheral rectangularly-shaped portion 80 with an upstanding head rail 82 in which a generally semi-circular recess 84 is formed in a front face 86. The semi-circular shaped recess opens toward the rectangular frame portion 80. The recess communicates with a maneuver slot 88 in the opposite or rear face 90 of the head rail with both the slot and the recess having arcuate upper surfaces for a purpose to be described hereafter. Within the rectangular peripheral frame portion 80 of the base frame, a ledge 92 is provided at both the head and the foot of the opening which projects into a rectangular opening 94 so as to establish a smooth interrupted top surface 96 and a bottom surface 98 having limit blocks 100 at opposite ends. The slide component 78 of the base is adapted to be seated within the rectangular opening 94 defined by the frame portion for lateral sliding movement as will be described hereafter.

Figure 14:
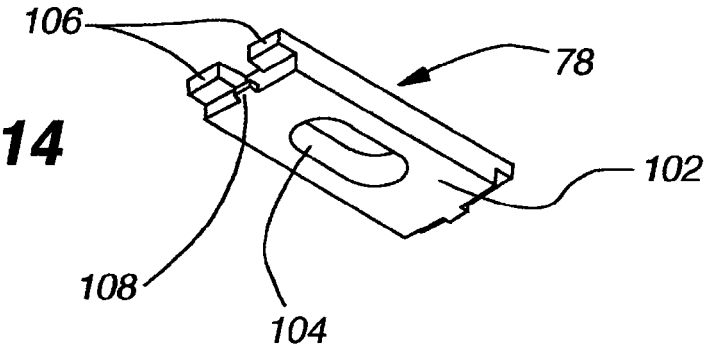
FIG. 14 is a isometric looking at the bottom of the slide component of the base.
Figure 16:
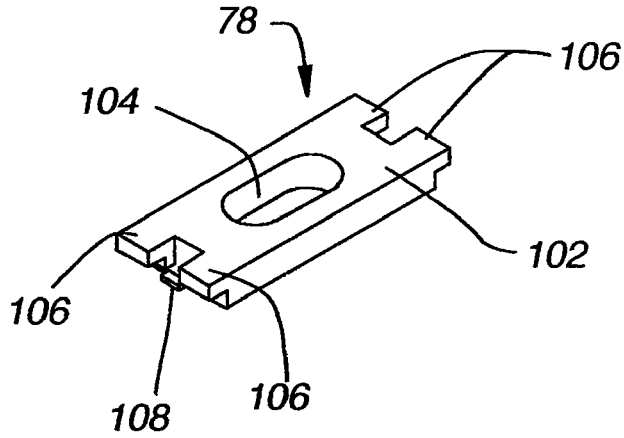
FIG. 16 is an isometric looking downwardly on the slide component.

The slide component or member 78, which is probably best seen in FIGS. 14 and 16, has a generally rectangular body 102 with an elongated ovular slot 104 centered along its length and with two enlarged spaced projections 106 at opposite ends along its top surface. A single relatively thin centered projection 108 is provided along the lower surface of the base at both ends.

Figure 19:
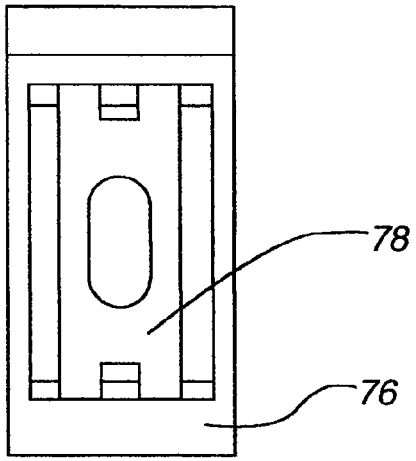
FIG. 19 is a top plan view of the base as seen in FIG. 18 with the side component centered relative to the frame.
Figure 20:
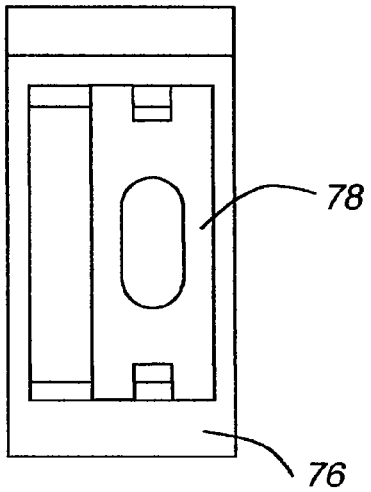
FIG. 20 is a top elevation similar to FIG. 19 with the slide component in a right position.
Figure 21:
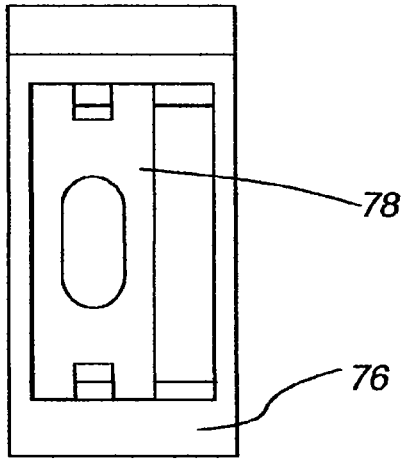
FIG. 21 is a top plan view similar to FIG. 19 with the slide component in a left position.

The entire clip 60 is made of a rigid but somewhat flexible and somewhat resilient material such as polyethylene, polyurethane or the like so that particularly the relatively thin centered projections 108 (seen best in FIGS. 14 and 16) at each end of the body 102 will flex and return to the normal configuration shown in FIGS. 14 and 16. The slide member 78 can therefore be inserted into the rectangular opening 94 of the base frame component 76 by positioning one end of the slide member so that its two large upper projections 106 rest on the upper surface of a ledge 92 and the relatively small centered projection 108 is position beneath the ledge. The opposite end of the slide member can then be forced downwardly until the relatively thin centered projection 108 snaps across the associated ledge and is thereafter positioned beneath the ledge. With the slide member so positioned within the base frame component, it can be slid laterally as shown in FIGS. 19-21 to any necessary position for desirable mounting. FIG. 19, for example, shows the slide member 78 centered within the frame component 76, FIG. 20 in a right position, and FIG. 21 in a left position.

The ovular slot 104 in the center of the slide component 78 is adapted to receive a screw-type fastener 110 for securing the base of the clip to the smooth uninterrupted surface 54 surrounding the architectural opening. As will be appreciated, if the screw is not precisely positioned at a desired location on the surface, the base 68 can be slid longitudinally relative to the screw due to the ovular configuration of the opening through which the screw is passed and the slide can be moved laterally as illustrated in FIGS. 19-21 so that the base is universally movable about the fastener within pre-defined limits.

Figure 25:
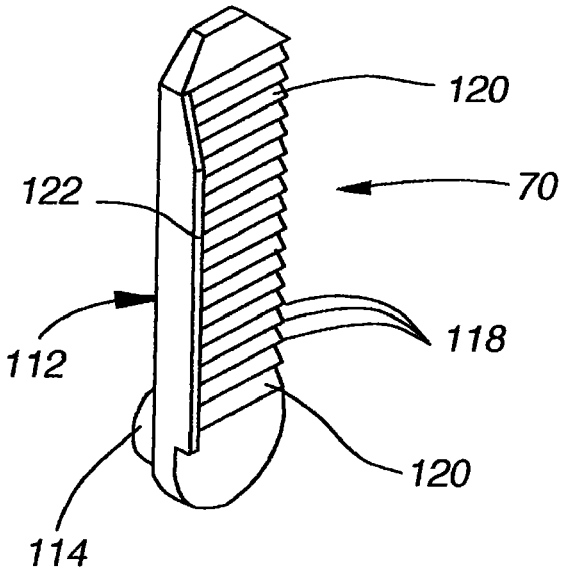
FIG. 25 is an isometric of the pivot arm looking at the rear side thereof.
Figure 26:
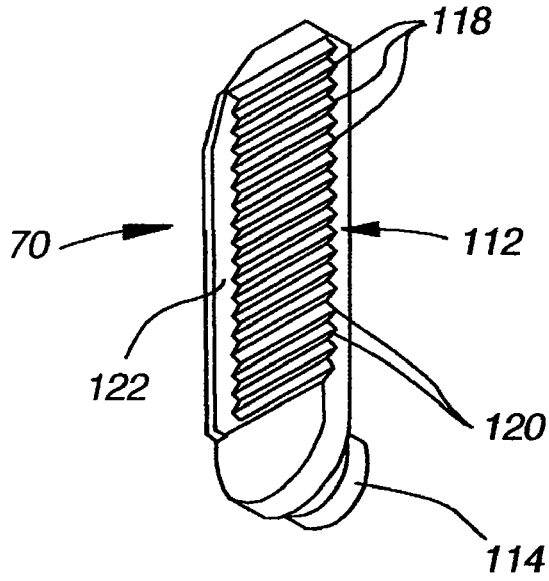
FIG. 26 is an isometric similar to FIG. 25 looking upwardly at the rear side of the pivot arm.
Figure 27:
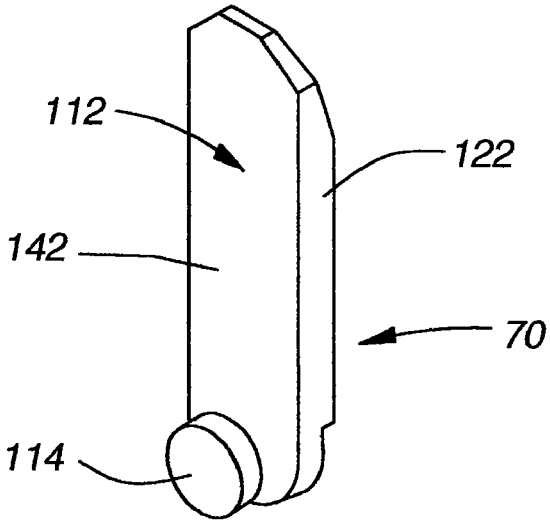
FIG. 27 is an isometric looking downwardly on the front of the pivot arm.
Figure 28:
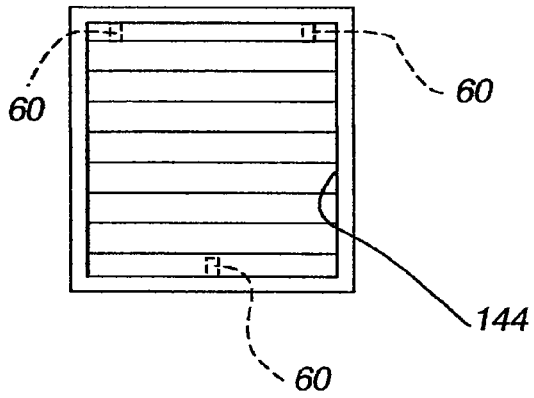
FIG. 28 is a front elevation showing the mounting system of the present invention in a rectangular architectural opening.

The pivot arm 70, seen best in FIGS. 25-27 is an elongated generally rectangular bar 112 and a circular disk or pivot pin 114 projects laterally from one end that is spaced from the bar by a cylindrical neck 116 (FIGS. 5 and 6). The disk is sized and configured to pivotally fit within the generally semi-circular recess 84 in the head rail 82 of the base and the neck 116 is sized and configured to fit within the narrow slot 88. The disk is inserted into the recess through the bottom of the base as illustrated in FIG. 11 and is confined within the generally semi-circular recess once the base has been secured to the flat surface frame surface 54 surrounding the architectural opening. Once the pivot arm is mounted on the base as described, it is free to pivot about an axis of the pivot pin or disk 114 in a single plane within an approximately 180° arc. The rear side of the pivot arm has serrated teeth 118 defined by transversely disposed grooves 120 and an upstanding guide rail 122 extends along the length of the arm at one side of the serrated teeth. The slide clamp 72 mounts on the lever arm for sliding movement along the guide rail as will be described later.

Figure 22:
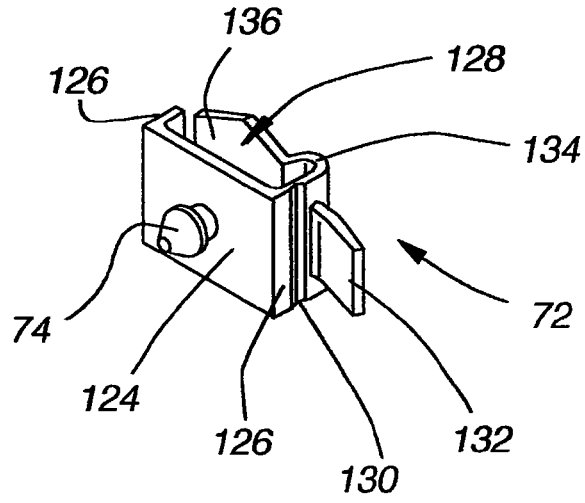
FIG. 22 is an isometric looking at the front of the clamp component of the clip.
Figure 23:
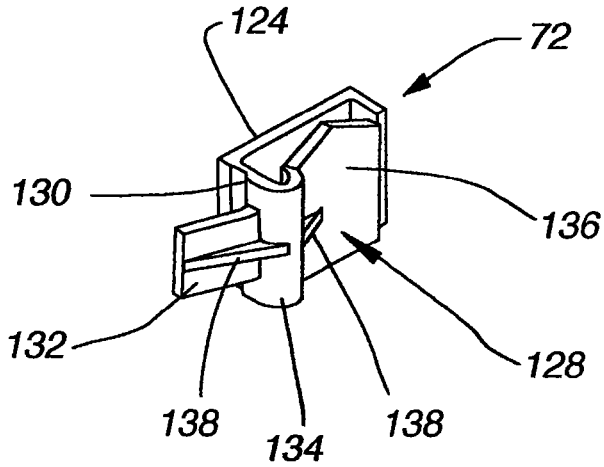
FIG. 23 is an isometric looking downwardly at the rear of the clamp shown in FIG. 22.
Figure 24:
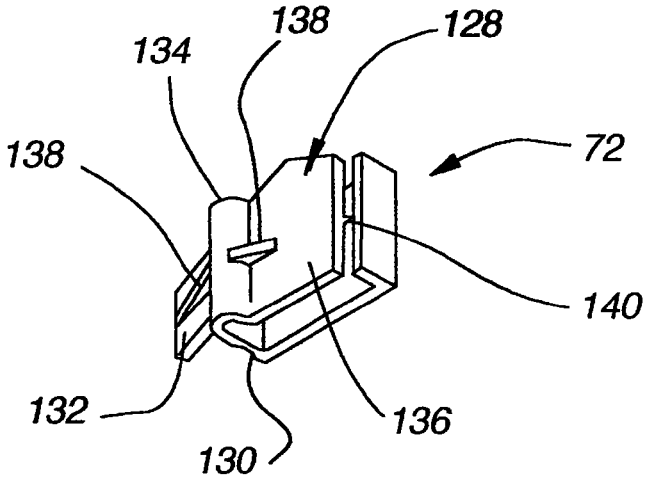
FIG. 24 is an isometric looking upwardly at the bottom and from the back of the clamp shown in FIG. 22.

The slide clamp 72 is seen in FIGS. 22-24 to include a base 124, from which the taper head pin 74 projects off one side, and two projecting legs 126 along longitudinal sides of the base which project in an opposite direction from the taper head pin. A shorter one of the two sides is connected to a pivot plate 128 through a living hinge 130. The pivot plate is movable by a finger tab 132 projecting laterally from the pivot plate with the pivot plate including an arcuate edge 134 and a planar main body 136. Gussets 138 are provided between the planar main body 136, the finger tab 132 and the arcuate edge 134 for structural integrity. As probably best seen in FIG. 24 and better in FIGS. 5 and 6, a transverse tooth 140 is provided on the inner face of the pivot plate 128 with the transverse tooth being adapted to engage and be restrained within a groove 120 between serrated teeth of the bar 112. The transverse tooth can be moved in and out of the serrated teeth for desirable slidable positioning of the clamp on the pivot arm 70 by depressing the finger tab which causes the pivot plate to swing outwardly removing its transverse tooth from a groove between serrated teeth. Of course releasing the finger tab allows the tooth to re-engage a groove between serrated teeth at a desired location along the length of the pivot arm due to the resiliency of the material from which the clamp is made.

The slide clamp 72 is mounted on the pivot arm 70 as possibly best seen in FIGS. 10 and 11 so that the base 124 confronts the smooth front surface 142 of the pivot arm and the side legs 126 project along the corresponding sides of the bar 112. The arcuate edge 134 of the pivot plate 128 overhangs the guide rail 122 of the pivot arm to guide sliding movement of the clamp between releasably fixed positions.

It will be appreciated from the above that due to the sliding movement of the clamp 72 along the length of the pivot arm 70, which correspondingly moves the taper head pin 74 along the same path, combined with the pivotal movement of the pivot arm 70 establishes universal movement of the taper head pin in a plane perpendicular to the base 68 of the clip. Accordingly, with universal movement of the taper head pin within a plane perpendicular to the base and universal movement of the base relative to the screw-type fastener, the taper head pin is movable into an infinite number of desired positions so that it can be aligned with an opening or perforation 64 in the anchor tape 62 on the covering material 40. Once aligned with an opening in the anchor tape, the taper head pin can be forced through the opening and snap fit into locking engagement therewith as probably best appreciated by reference to FIGS. 5 and 6.

FIG. 5 is an illustration showing the clip 60 mounted on the bottom surface 46 of the frame 52 of the architectural opening so that the base 68 of the clip is properly positioned and secured to the frame with the pivot arm 70 kept within the semi-circular recess 84 with the circular disk 114. The pivot arm is swung or pivoted as illustrated in FIGS. 7-9 into any desired location where the taper head pin 74 is aligned with an opening 64 through the anchor tape 62. The taper head pin is shown inserted through such an opening in FIG. 5 so that the covering material is positively held in position at the bottom of the architectural opening 42 by the clip. FIG. 6 illustrates the clip at the upper right of the architectural opening with the clip again being secured to the smooth inner wall 54 of the frame of the architectural opening with a fastener 110 so that the base pivotally captures the pivot arm 70 and the clamp 72 can be moved along the pivot arm and locked into a desired position for insertion into an opening in the anchor strip.

It will be appreciated by reference to FIGS. 1 and 2 that when each edge of the covering material 40 is secured to the frame 52 with a clip 60 as described previously, the covering material is held in a fully extended position covering the entire architectural opening 42 as desired.

It will be appreciated from the above that the mounting system 44 of the present invention can be used in architectural openings of numerous configurations with some of those configurations illustrated in FIGS. 28-32. While the clips 60 can be positioned at any location desired along the frame for the opening for properly suspending the covering material 40, in FIG. 28 where a rectangular opening 144 is illustrated, there are two clips 60 along the top of the covering material and one clip 60 centered along the bottom.

Figure 29:
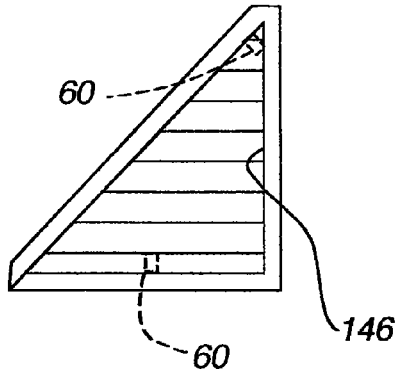
FIG. 29 is a front elevation of the mounting system of the present invention in a triangular architectural opening.

In FIG. 29, a triangular opening 146 is illustrated with a covering material therein with only two clips 60 being necessary to support the covering material with one clip 60 adjacent to the top pointed edge and the other clip 60 centered along the bottom.

Figure 30:
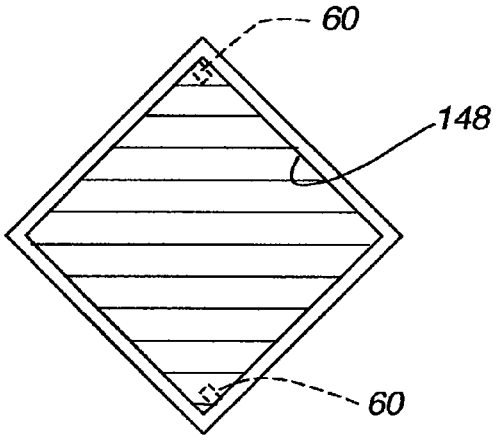
FIG. 30 is a front elevation of the mounting system of the present invention in a diamond shaped architectural opening.

FIG. 30 illustrates a diamond-shaped architectural opening 148 with the covering material therein being secured with one clip 60 adjacent to the top point of the diamond and another clip 60 adjacent to the bottom point.

Figure 31:
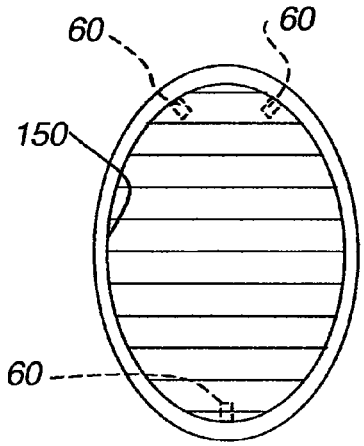
FIG. 31 is a front elevation of the mounting system of the present invention in an ovular architectural opening.

FIG. 31 illustrates an oval-shaped architectural opening 150 with two clips 60 spaced adjacent to the top of the opening and one clip 60 at its bottom.

Figure 32:
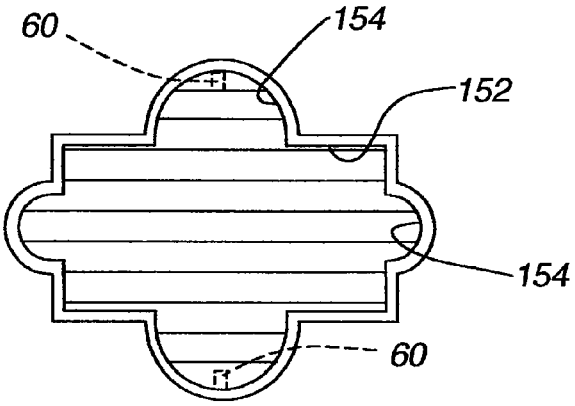
FIG. 32 is a front elevation of the mounting system of the present invention in a rectangular architectural opening with arcuate sides.

FIG. 32 illustrates an unusual architectural opening 152 of generally rectangular configuration having arched protrusions 154 along each side and with a covering material secured within the opening with a clip 60 within the arcuate protrusion adjacent at the top and the arcuate protrusion at the bottom.

Figure 33:
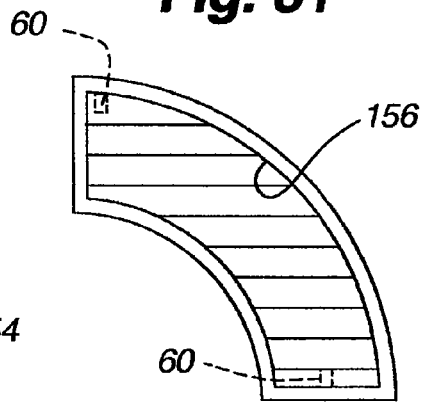
FIG. 33 is a front elevation of the mounting system of the present invention in an arcuate architectural opening.

FIG. 33 represents an arcuate opening 156 where the covering material is secured with one clip 60 in an upper top corner and another clip 60 centered along a bottom edge.

Although the present invention has been described with a certain degree of particularity, it is understood the disclosure has been made by way of example, and changes in detail or structure may be made without departing from the spirit of the invention as defined in the appended claims.

The invention claimed is:

1. A system for mounting a covering material in the frame of an architectural opening comprising in combination:

an anchor strip attachable to said material, said anchor strip including a plurality of openings, and a clip securable to the anchor strip and said frame, said clip including a base attachable to said frame with a fastener, a pivot arm pivotally mounted on said base, a pivot pin defining a pivot axis and operatively interconnecting said pivot arm to said base to permit pivotal movement of said pivot arm in a plane only about said pivotal axis, and a clamp movable along said pivot arm between releasably fixed positions, said clamp including an attachment pin for insertion through one of said openings in said anchor strip for attaching said anchor strip to said material.

2. A system for mounting a covering material in the frame of an architectural opening comprising in combination:

a frame at least substantially surrounding said opening, a covering material substantially filling said opening, said material having a peripheral edge adjacent to said frame, an anchor strip having a plurality of spaced openings secured to said material at least partially along said peripheral edge, and at least two clips secured to said frame, said clips including an elongated pivot arm, a pivot pin, and an anchor pin securable to said anchor strip, said pivot arm being pivotally mounted on said pivot pin for pivotal movement about a pivot axis defined by said pivot pin with said pivotal movement being in a single plane, said anchor pin being adjustably movable along the length of said pivot arm whereby said anchor pin is universally movable and releasably positionable in one of said plurality of openings relative to said anchor strip.

3. The system of claim 2 wherein each of said clips includes a base securable to said frame and an arm pivotally connected to said base, said anchor pin being secured to said arm.

4. The system of claim 3 further including a slide clamp on which said anchor pin is mounted, said slide clamp being slidably movable along said arm between selectable positions.

5. The system of claim 4 further including a fastener for securing said base to said frame, said base being movable relative to said fastener in two mutually perpendicular directions.

6. The system of claim 4 wherein said anchor strip includes a plurality of holes therethrough and said anchor pin has a tapered head which is insertable through one of said holes.

7. The system of claim 4 wherein one of said slide clamp or arm includes serrated teeth and the other of said slide clamp and arm includes a tooth releasably engageable with said serrated teeth.

8. The system of claim 1 or 2 wherein said covering material is further anchored to said frame at an opposing side of said frame from said clip.

9. The system of claim 8 wherein said anchoring of said material at said opposing side is with a second clip identical to said first clip.

* * * * *